US006572364B2

(12) United States Patent
Kawauchi et al.

(10) Patent No.: US 6,572,364 B2
(45) Date of Patent: Jun. 3, 2003

(54) COMBUSTION CONTROL APPARATUS

(75) Inventors: Hajime Kawauchi, Ishikawa-ken (JP); Toshihisa Terade, Ishikawa-ken (JP)

(73) Assignee: RB Controls Co., Ltd., Ishikawa-ken (JP)

( * ) Notice: Subject to any disclaimer, the term of this patent is extended or adjusted under 35 U.S.C. 154(b) by 0 days.

(21) Appl. No.: 09/906,852

(22) Filed: Jul. 18, 2001

(65) Prior Publication Data

US 2002/0048736 A1 Apr. 25, 2002

(30) Foreign Application Priority Data

Oct. 19, 2000 (JP) ..... 2000-319907

(51) Int. Cl.[7] ..... F23K 5/18

(52) U.S. Cl. ..... 431/18; 431/24

(58) Field of Search ..... 60/39.06; 364/164; 431/18, 24, 26, 27, 12

(56) References Cited

U.S. PATENT DOCUMENTS 4,545,009 A * 10/1985 Muraki et al. ..... 364/164
5,487,266 A * 1/1996 Brown ..... 60/39.06

* cited by examiner

*Primary Examiner*—Henry Bennett
*Assistant Examiner*—Sabrina Dagostino
(74) *Attorney, Agent, or Firm*—Arent Fox Kintner Plotkin & Kahn

(57) ABSTRACT

A conventional watchdog timer circuit is arranged to judge a microcomputer to be normal as long as a pulse signal is being outputted from the microcomputer. Therefore, an abnormal condition cannot be detected when an operating frequency of the microcomputer lowers, for example. As a solution, the watchdog timer circuit is provided with a function for detecting the frequency. If the frequency of the pulse signal deviates from a predetermined frequency range, a reset signal is outputted indicating that the microcomputer is abnormal, even if the pulse signal is being outputted. A solenoid-operated gate valve is thereby closed to stop the supply of gas to a gas burner.

4 Claims, 2 Drawing Sheets

COMBUSTION CONTROL APPARATUS

BACKGROUND OF THE INVENTION

1. Field of the Invention

The present invention relates to a combustion control apparatus which controls the combustion in a gas burner which is contained inside a gas appliance such as a gas-operated water heater or the like.

2. Description of Related Art

As this kind of combustion control apparatus, there has hitherto been known the following. Namely, a solenoid-operated gate valve is interposed as a safety valve in a gas supply passage which supplies a gas burner with gas. When an operation for igniting the gas is performed, a microcomputer recognizes the ignition operation. A solenoid of the gate valve is then supplied with electric current, thereby opening the gate valve. In this kind of combustion control apparatus in which the combustion is controlled with the microcomputer, the following is necessary. Namely, if the ignition is not confirmed by a flame rod which is provided in the neighborhood of a flame peep hole in the gas burner, even after the lapse of a predetermined time from the start of ignition, the gate valve must be closed. In addition, also in case the flame of the gas burner has failed for some reasons after the gas was once ignited, the gate valve must similarly be closed. An output signal of the flame rod is constantly monitored by the microcomputer. In case the microcomputer judges that the ignition has not taken place after the lapse of a predetermined time from the start of ignition, or in case the microcomputer judges that the flame of the gas burner has failed in the course of combustion, the microcomputer shuts off the electric current which is being supplied to the solenoid of the gate valve, thereby closing the gate valve.

In this manner, since the microcomputer operates especially to close the gate valve, there is the following disadvantage. Namely, even in case the gate valve must be closed because the signal from the flame rod does not attain the ignited state, there will arise a state in which the gate valve is not closed if the microcomputer runs away out of control. As a solution, there is provided a watchdog timer circuit (WDT circuit) so that, when an abnormal condition such as the microcomputer's runaway or the like occurs, the gate valve is forcibly closed by the watchdog timer circuit.

The conventional watchdog timer circuit functions to judge the presence or absence of a signal. In other words, a signal is outputted to the watchdog timer circuit at a predetermined cycle. As long as the signal is being outputted from the watchdog timer circuit, the watchdog timer does not output a reset signal on the assumption that the microcomputer is operating normally. Instead, when the signal from the microcomputer is stopped due to the microcomputer's runaway or the like, the watchdog timer circuit outputs the reset signal to the microcomputer, thereby resetting the microcomputer. Once the microcomputer has been reset, the gate valve is closed because the electric current is forcibly stopped even if it is being supplied to the solenoid of the gate valve. The supply of the gas to the gas burner is thus stopped.

The microcomputer is provided with an oscillator section such as a crystal oscillator or the like. The operation speed of the microcomputer is dependent on the oscillation frequency of the oscillator section. Should the oscillation frequency vary for some reasons, the operation speed of the microcomputer also varies in a manner interlocked with the change in the oscillation frequency. For example, if the oscillation frequency becomes lower by 40%, the time for the timer inside the microcomputer to count becomes longer by 40%. As an example, in case the gate valve is so programmed as to be closed if ignition does not take place during a period of time of 10 seconds from the start of ignition, there is a case in which 14 seconds has actually passed from the time of ignition to the time of closing the gate valve, even if the gate valve is closed after a lapse of 10 seconds as counted by a clock inside the microcomputer.

However, the watchdog timer circuit used in the above-described conventional combustion control apparatus judges only as to whether a signal from the microcomputer is being outputted or not. Therefore, in a state in which the signal is being outputted to the watchdog timer circuit even though the oscillating frequency has varied, the watchdog timer circuit cannot detect the abnormal condition. As a result, the microcomputer will not be reset.

In view of the above-described disadvantages, the present invention has an object of providing a combustion control apparatus in which the gas supply to the gas burner is stopped also in case the oscillating frequency deviates, aside from the case of the microcomputer's runaway, or the like.

SUMMARY OF THE INVENTION

In order to attain the above and other objects, the present invention is a combustion control apparatus comprising: a first closing means for closing a gas supply passage which supplies a gas burner with gas, thereby stopping gas supply to the gas burner; a microcomputer for operating the first closing means on a predetermined occasion; and a watchdog timer circuit for monitoring an operating state of the microcomputer based on a pulse signal which is outputted from the microcomputer, wherein, when a frequency of the pulse signal which is outputted from the microcomputer to the watchdog timer circuit deviates from a predetermined frequency range which is based on a reference frequency, the first closing means is operated as an abnormal condition of the microcomputer, thereby stopping the gas supply to the gas burner, even in a state in which the pulse signal is being outputted.

In the conventional watchdog timer circuit, as long as a signal is being outputted from the microcomputer, the microcomputer is judged to be normal. Therefore, when the operation speed of the microcomputer has lowered, it is impossible to take any correcting measures. In the above-described arrangement according to the present invention, on the other hand, an arrangement has been made that the gas supply to the gas burner is stopped when the frequency of the pulse signal deviates from the above-described predetermined frequency range. Therefore, the unburned gas can be prevented from being discharged out of the gas burner for more than an originally scheduled period of time.

It is also possible that the watchdog timer itself gets out of order. In such a case, it is preferable to make an arrangement that the microcomputer outputs into the watchdog timer circuit a pulse signal which is away from the predetermined frequency range when a combustion control is started, thereby checking the watchdog timer circuit.

In case the pulse signal to be outputted from the microcomputer deviates from the predetermined frequency range, the gate valve is closed by resetting the microcomputer, or the like operation. Preferably, the combustion control apparatus further comprises a second closing means for directly stopping the gas supply by the watchdog timer circuit without an operation of the microcomputer. The second closing means is then operated when the pulse signal deviates from the predetermined frequency range. In this arrangement, the gas supply to the gas burner can be stopped in a surer way.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF A PREFERRED EMBODIMENT

Figure 1:
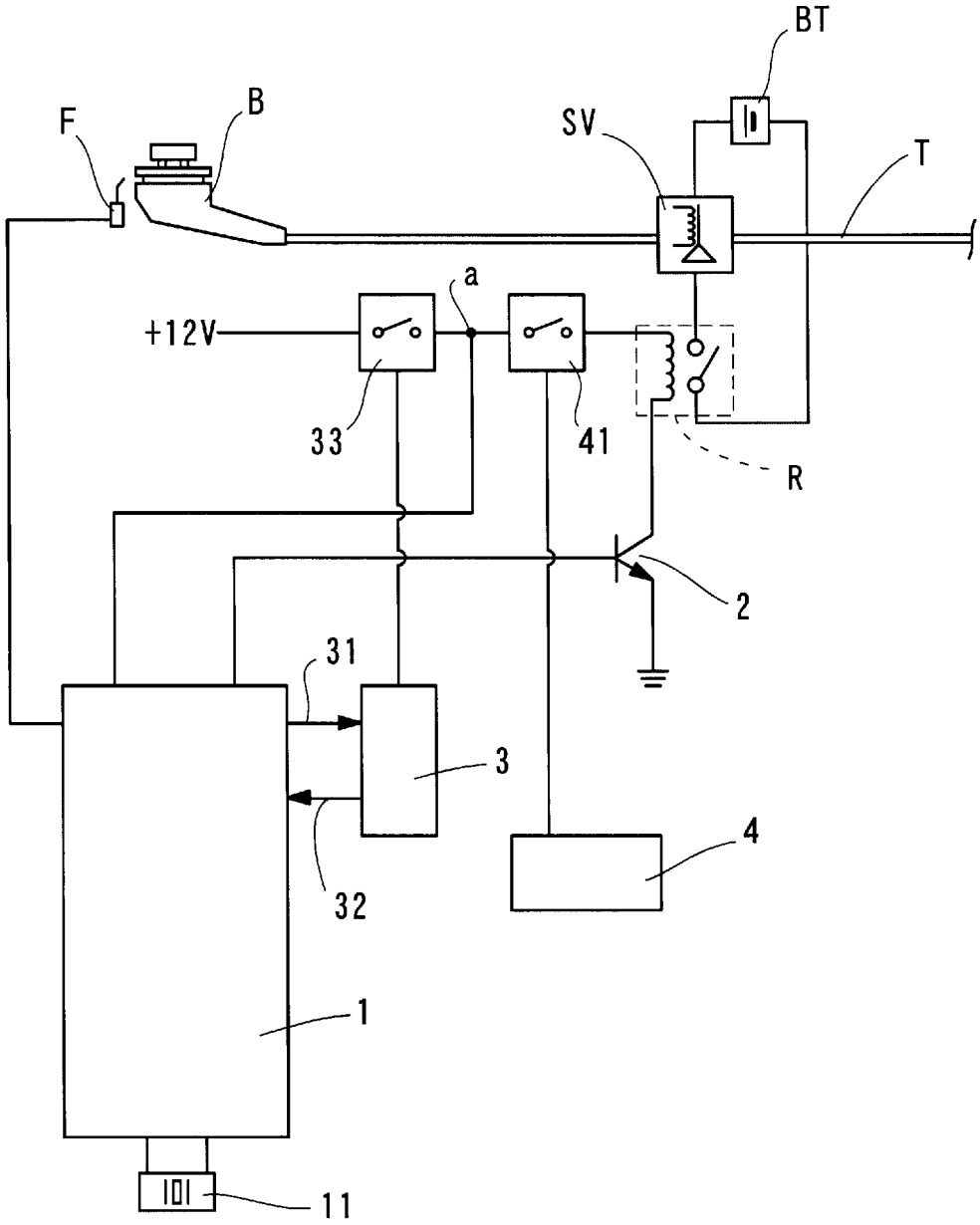
FIG. 1 is a block diagram showing the construction of one example of the present invention.

In FIG. 1, reference alphabet B denotes a gas burner which is supplied with gas through a gas supply passage T. The gas supply passage T has interposed therein a solenoid-operated gate valve SV which serves as a safety valve. Reference alphabet BT denotes a power source for driving the gate valve SV. When a relay R is switched on, a solenoid of the gate valve SV is supplied with electric current from a driving power source BT, whereby the gate valve SV is opened. When the relay R is switched off, on the other hand, the gate valve SV is closed by an urging force of a spring (not illustrated) which is contained therein. The safety valve SV, the power source BT and the relay R constitute the first closing means.

The state of switching on and off of the relay R can be shifted (or changed over) by a microcomputer 1. A transistor 2 is connected in series with an energizing coil of the relay R so that the transistor 2 can be switched on and off by a signal from the microcomputer 1.

Reference numeral 3 denotes a watchdog timer circuit (hereinafter called a WDT circuit), which resets the microcomputer 1 in the following manner. Namely, it receives, as an input, a watchdog signal 31 which is a pulse signal to be outputted from the microcomputer 1. When the operation of the microcomputer 1 is abnormal, a reset signal 32 is outputted to the microcomputer 1 based on the watchdog signal 31, thereby resetting the microcomputer 1. Reference numeral 33 denotes a transistor which is connected in series with the energizing coil of the relay R. The transistor 33 is normally kept switched on, but is switched off by the WDT circuit 3 simultaneously when the WDT circuit 3 outputs the reset signal 32.

Reference numeral 41 denotes a transistor which is similar to the transistor 33. The transistor 41 is switched from the switched-on state to the switched-off state by a timer circuit 4 which is provided separate from the microcomputer 1.

An electric potential in an intermediate point "a" between the transistor 33 and the transistor 41 is monitored by the microcomputer 1. When the transistor 33 is switched off by the WDT circuit 3, the electric potential at the point "a" lowers from 12V to 0V. The microcomputer 1 thus detects, from this drop in the electric potential, the fact that the transistor 33 has been changed to the switched-off state.

A flame rod F for detecting a flame is provided in the neighborhood of a flame peep hole (not illustrated) in the gas burner B, and the output of the flame rod F is inputted into the microcomputer 1. The microcomputer 1 is additionally provided with an oscillator element 11, and is operated in a manner synchronized with an operation signal to be outputted by the oscillator element 11.

Figure 2:
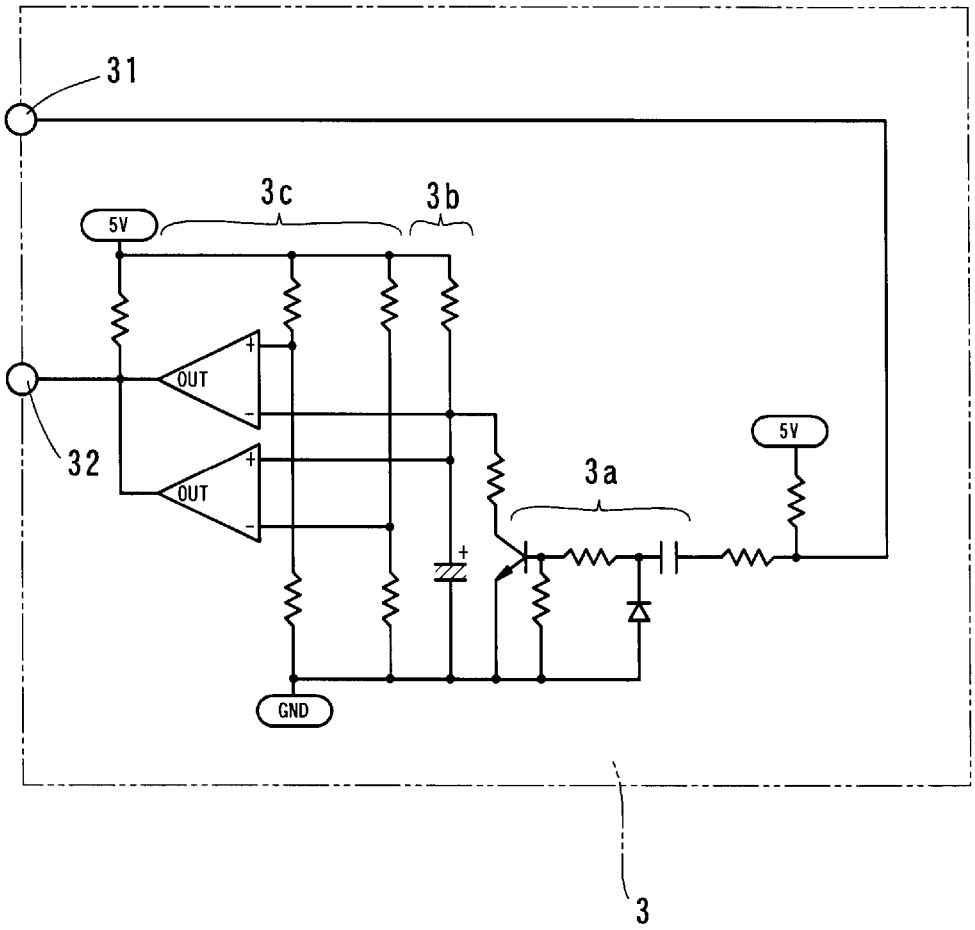
FIG. 2 is a circuit diagram showing one example of a watchdog timer circuit.

The WDT circuit 3 has the following arrangement. Namely, it monitors the variation in the frequency of the watchdog signal 31. If the watchdog signal 31 varies more than 40% relative to a reference frequency, the reset signal 32 is outputted. As long as the above-described functions are performed, any other circuit arrangements will serve the purpose. The circuit in the illustrated embodiment has the following arrangement as shown in FIG. 2. Namely, the watchdog signal 31 is differentiated by a differential circuit section 3*a* at an initial stage. At each of the pulses of the watchdog signal 31, a capacitor in a smoothing circuit section 3*b* is charged. The charged electric potential in the smoothing circuit section 3*b* is detected by the detection circuit section 3*c*. The reset signal 32 is outputted in either of the following cases, i.e., when the frequency of the watchdog signal 31 becomes high so that the charged electric potential in the smoothing circuit section 3*b* becomes high, and when the frequency of the watchdog signal 31 becomes low so that the charged electric potential in the smoothing circuit section 3*b* becomes low. In FIG. 2, the circuit which is contained inside the WDT circuit 3 and which operates to switch off the transistor 33 is omitted.

In the above-described arrangement, when a command for combustion of the gas burner B has been made, the microcomputer 1 makes the transistor 2 into a switched-on state to switch on the relay R, whereby the gate valve SV is opened. Further, simultaneously with the opening of the gate valve SV or ahead of the opening thereof, a spark is generated between an ignition plug (not illustrated) and the gas burner BT, thereby igniting the gas to be discharged out of a flame hole of the gas burner B. Once the gas burner B has been ignited, the flame comes into contact with the flame rod F. Due to the rectifying effect of the flame, an electric current flows between the flame rod F and the gas burner B. Once the electric current flows, the microcomputer 1 detects the fact that the gas burner B has been ignited, and the electric discharging from the ignition plug is stopped.

The microcomputer 1, on the other hand, starts clocking work simultaneously with the opening of the gate valve SV. If the ignition cannot be confirmed within 7 seconds of the opening of the gate valve SV, the microcomputer 1 judges that the ignition has failed, and the transistor 2 is switched off. The reason for having set the time to 7 seconds is to make sure that the actual non-ignited time does not exceed 10 seconds, even in case the operation speed of the microcomputer 1 has lowered as described hereinbelow. The operation speed of the microcomputer 1 is proportional to the oscillating frequency of the oscillating element 11 as described above. Therefore, if the oscillating frequency lowers by 40% as compared with the normal frequency, the actual time of lapse will amount to as many as 14 seconds even if the microcomputer 1 intends to have counted 10 seconds. The watchdog signal 31 is being outputted from the microcomputer 1 to the WDT circuit 3. If the reference frequency of the watchdog signal 31 is supposed to be 50 Hz, for example, the WDT circuit 3 is set such that the reset signal 32 is outputted to the microcomputer 1 and the transistor 33 is switched off if the watchdog signal 31 has exceeded 50 Hz by a respective range of 20 Hz above and below.

Further, in this embodiment, the following arrangement is also employed. Namely, the timer circuit 4 starts the operation of its own time counting from the time of opening the gate valve SV. If the ignition has not been confirmed at the point of time exceeding 10 seconds in the time counted by the timer circuit 4, the timer circuit 4 operates to switch off the transistor 41, thereby forcibly closing the gate valve SV.

Once the ignition operation is performed, the microcomputer 1 outputs to the WDT circuit 3, before switching on the transistor 2, at least one of a watchdog signal above 70 Hz and a watchdog signal below 30 Hz. By thus detecting that the transistor 33 is switched off and therefore that the electric potential at point "a" drops, the WDT circuit 3 can be tested. At the time of this testing, the reset signal 32 is outputted to the microcomputer 1, but the microcomputer 1 is arranged not to be reset by the reset signal 32 to be outputted at the time of testing.

As can be seen from the above explanations, according to the present invention, the watchdog timer circuit (WDT circuit) is provided with the function of detecting the frequency. Therefore, the apparatus of the present invention can detect an abnormal condition, such as the lowering of the operating speed of the microcomputer, that cannot be detected by the conventional watchdog timer circuit. In this manner, the gas supply to the gas burner can surely be stopped in such an abnormal condition.

It is readily apparent that the above-described combustion control apparatus meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A combustion control apparatus comprising:

a first closing means for closing a gas supply passage which supplies a gas burner with gas, thereby stopping gas supply to the gas burner;

a microcomputer for operating said first closing means on a predetermined occasion; and a watchdog timer means for monitoring an operating state of said microcomputer based on a pulse signal which is outputted from said microcomputer, wherein, when a frequency of the pulse signal which is outputted from said microcomputer to said watchdog timer circuit deviates from a predetermined frequency range which is based on a reference frequency, said first closing means is operated as an abnormal condition of said microcomputer, thereby stopping the gas supply to said gas burner, even in a state in which the pulse signal is being outputted.

2. The combustion control apparatus according to claim 1, wherein said microcomputer outputs into said watchdog timer circuit a pulse signal which is away from said predetermined frequency range when combustion control is started, thereby checking said watchdog timer circuit.

3. The combustion control apparatus according to claim 1, further comprising a second closing means for directly stopping the gas supply by said watchdog timer circuit without an operation of said microcomputer, wherein said second closing means is operated when the pulse signal deviates from said predetermined frequency range.

4. The combustion control apparatus according to claim 2, further comprising a second closing means for directly stopping the gas supply by said watchdog timer circuit without an operation of said microcomputer, wherein said second closing means is operated when the pulse signal deviates from said predetermined frequency range.

* * * * *